United States Patent [19]

McClure et al.

[11] 3,960,070

[45] June 1, 1976

[54] OBJECT COMPACTING DEVICE

[76] Inventors: David L. McClure, 2246 W. Palo Alto Ave., Fresno, Calif. 93705; Jeffrey D. Tweedie, 4756 E. Harvard Ave., Fresno, Calif. 93703

[22] Filed: Oct. 30, 1974

[21] Appl. No.: 519,061

[52] U.S. Cl. ..... 100/49; 100/53; 100/256; 100/218; 100/290; 241/99

[51] Int. Cl.[2] ..... B30B 15/14

[58] Field of Search ..... 241/99; 100/DIG. 2, 100/49, 53, 256, 290, 218, 251, 249

[56] References Cited

UNITED STATES PATENTS

| | | | |
|---|---|---|---|
| 2,537,920 | 1/1951 | Smith | 100/249 X |
| 2,737,995 | 3/1956 | Jennings | 100/DIG. 2 |
| 2,813,569 | 11/1957 | Nelson | 100/DIG. 2 |
| 2,904,097 | 9/1959 | Cohen | 100/53 |
| 3,024,720 | 3/1962 | Welsh | 100/53 |
| 3,034,422 | 5/1962 | Howell | 100/DIG. 2 |
| 3,062,130 | 11/1962 | Huber et al. | 100/DIG. 2 |
| 3,104,607 | 9/1963 | Galas | 100/53 |
| 3,204,550 | 9/1965 | Swiderski et al. | 100/218 X |
| 3,537,136 | 11/1970 | Solc | 100/251 X |
| 3,580,167 | 5/1971 | Simshauser | 100/218 X |

*Primary Examiner*—Billy J. Wilhite
*Attorney, Agent, or Firm*—Huebner & Worrel

[57] ABSTRACT

An object compacting device having a housing with a bearing plate and an entrance opening; a wall, having an object receiving passage, mounted in the housing to divide the housing into an object discharge compartment between the wall and plate and an object receiving compartment communicating with the entrance opening; a workbed secured in the receiving compartment of the housing in endward alignment with the receiving passage and in alignment with the entrance opening; a compression member; and a mechanism mounting the compression member for movement across the workbed to and from the receiving passage in response to the insertion of an object through the entrance opening and on to the workbed.

11 Claims, 10 Drawing Figures

OBJECT COMPACTING DEVICE

BACKGROUND OF THE INVENTION

The present invention relates to an object compacting device and more particularly to such a device appropriate for home use which is adapted to compress objects, such as beverage containers, without manual assistance and possesses the capability of dependable, fully automatic operation from insertion of the object into the device until discharge of the compacted object from the device without danger of injury to the operator.

The prior art is replete with compacting devices such as those disclosed by the Shiokawa U.S. Pat. No. 2,896,529; the Huber et al U.S. Pat. No. 3,062,130; the Mankki et al U.S. Pat. No. 3,062,131; the Swartz U.S. Pat. No. 3,079,856; the Galas U.S. Pat. No. 3,104,607; the Chapleau U.S. Pat. No. 3,106,888; the Taylor U.S. Pat. No. 3,208,372; the Hopkins U.S. Pat. No. 3,353,478; and the Brown et al U.S. Pat. No. 3,527,161. The device of the present invention has achieved a reliability of operation, a safety of performance, a reduction in size and a reduction in overall expense not heretofore achieved in such prior art devices.

The recent emphasis on the conservation of natural resources and the reduction of pollution as well as the constant desire for labor saving devices have provided an impetus to the development of methods and apparatus for compacting used products for ease of disposal or for re-use of their constituent raw materials. Containers in which various products and particularly those in which food products and beverages are packed and sold accumulate in profusion in the home so as to create a particularly acute problem for disposal. Yet such containers, and particularly those constructed of metal are easily recycled to reclaim their constituent raw material. Various devices have been developed to compact such containers and other refuse to facilitate disposal and/or recycling. Such prior art devices are characterized by a structure having a receptacle into which such used materials or objects are compressed until a predefined limit is reached. Upon reaching the given limit, the device must typically be opened for removal of the receptacle to permit disposal of the compressed material or objects and continued use of the apparatus.

Since such devices operate to accumulate the compacted material, they are usually of comparatively large size and accordingly require the use of relatively cumbersome and expensive operative elements. Such devices have not successfully combined the capability of reliably compacting items with the ability to operate in complete safety while being of a compact size and of a cost compatible with household use.

Therefore, it has long been recognized that it would be desirable to have an object compacting device capable of dependable, fully automatic operation without danger of injury to the operator and being of a size and cost acceptable for household use.

SUMMARY OF THE INVENTION

It is therefore an object of the present invention to provide an improved workpiece compacting device.

Another object is to provide such a device which is adapted to compact objects to facilitate disposal and/or reclamation of their constituent raw materials.

Another object is to provide such a device which operates fully automatically from insertion of an object into the device until discharge of the compacted object from the device.

Another object is to provide such a device which operates only in a protectively sealed environment to preclude injury to the operator thereof.

Another object is to provide such a device which incorporates interlocking safety features to permit virtually foolproof operation.

Another object is to provide such a device which achieves an efficiency of operation and a simplicity of structure not heretofore achieved by operating simultaneously to compact and to discharge the object from the device.

Another object is to provide such a device which compacts and discharges such objects therefrom individually rather than accumulating the compacted material.

A further object is to provide such a device which combines the attributes of dependability of performance and safety of operation, in a device at a cost suitable for household use.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
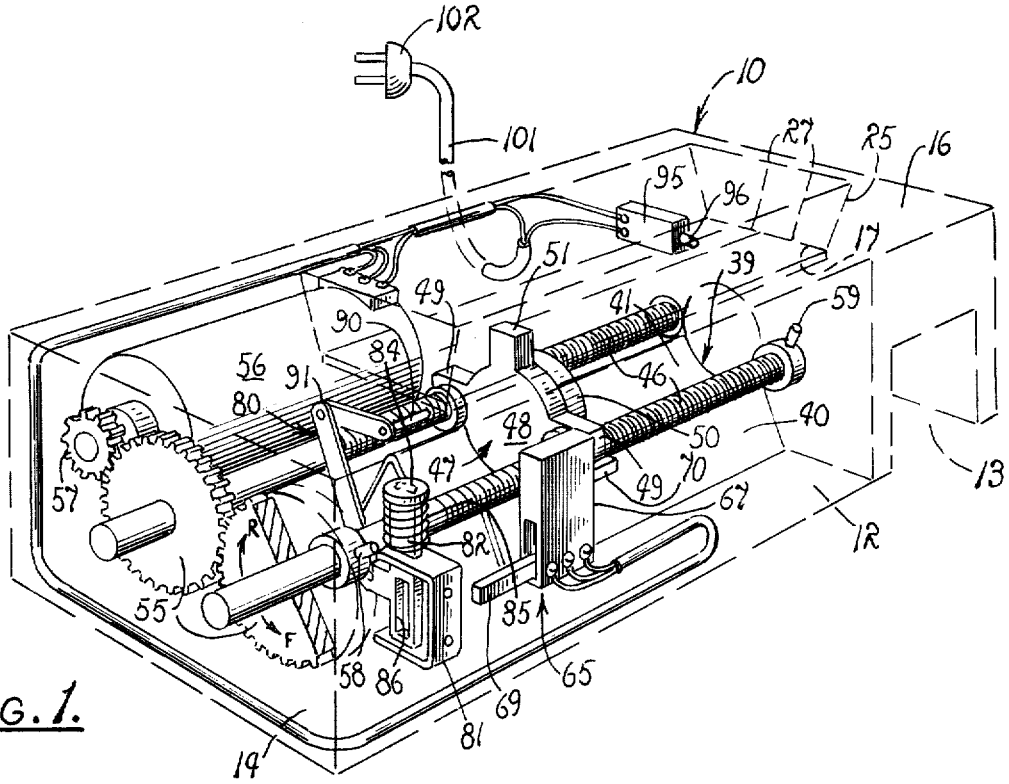
FIG. 1 is a fragmentary perspective view of the object compacting device of the present invention.

Referring more particularly to the drawings, the object compacting device of the present invention has a box-like housing 10 including a bottom wall 11 and a pair of upright substantially parallel side walls 12. Each of the side walls has a discharge opening 13, as best shown in FIG. 1. The housing has an end wall 14 and an opposite second wall or bearing plate 15 which serves as the other end wall for the housing. The housing also has a top wall 16 engaging the side walls, end wall, and bearing plate. The top wall has a substantially rectangular central insertion or entrance opening 17 extending therethrough. The housing is preferably constructed of metal in which case the top wall is removably held in position in engagement with the side walls, end wall and bearing plate by a plurality of sheet metal screws 18.

Figure 5:
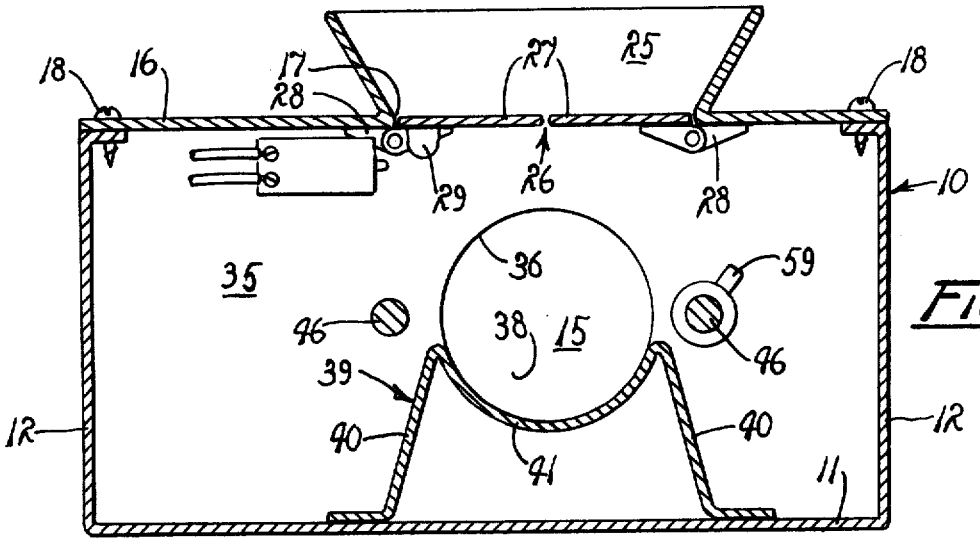
FIG. 5 is a somewhat enlarged transverse vertical section taken on line 5—5 in FIG. 2.
Figure 7:
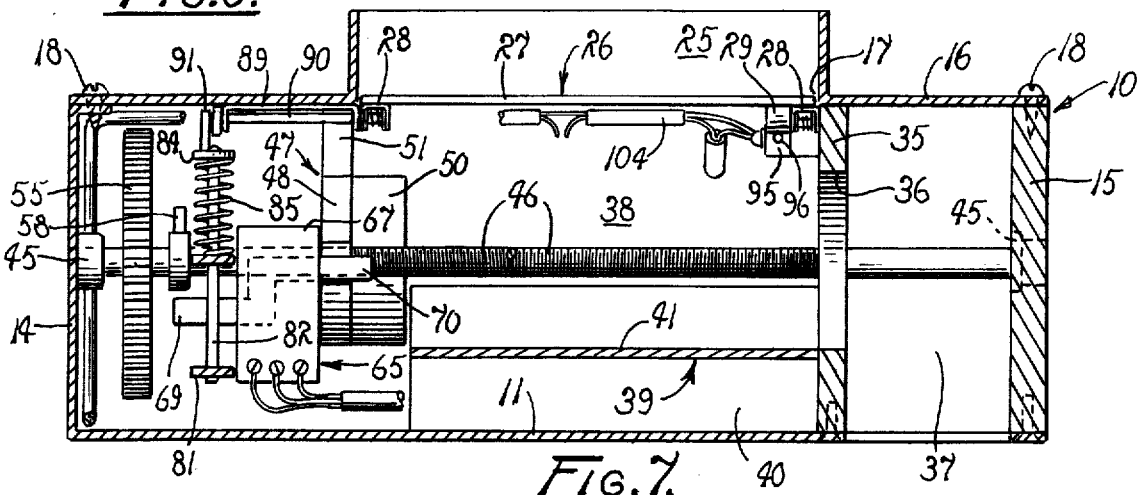
FIG. 7 is a longitudinal vertical section taken from a position indicated by line 7—7 in FIG. 6.

A hopper 25 is mounted on the top wall 16 of the housing 10 so as to bound the insertion opening 17, as best shown in FIGS. 2 through 5. A door assembly 26 is operatively mounted on the top wall of the housing within the insertion opening. The door assembly is composed of a pair of juxtaposed doors 27. Each door is individually pivotally mounted on the top wall by a pair of spring tensioned pivotal connections 28. The connections operate resiliently to maintain the doors in the normal, juxtaposed configuration shown in the drawings, but permit the doors to pivot inwardly of the housing under the weight of an object, such as a beverage container, deposited in the hopper rested on the doors. As best shown in FIGS. 5 and 7, a cam 29 is mounted on the door on the left as viewed in FIG. 5 in a predetermined position.

A first or interior wall 35, having a guide opening or passage 36 extending substantially centrally therethrough, is mounted in the housing 10 in spaced, substantially parallel relation to the bearing plate 15 thereof on the opposite side of the discharge openings 13 of the side walls 12 from the bearing plate. The interior wall divides the interior of the housing into a discharge compartment or passage 37, disposed between the interior wall and bearing plate and communicating with the discharge openings, and an object receiving compartment 38 disposed between the interior wall and the end wall 14 of the housing. A workbed 39, composed of a pair of supports 40 interconnected by a transversely concave portion 41, is mounted on the bottom wall 11 of the housing 10 in longitudinal alignment with the guide passage of the interior wall and opposite the insertion opening 17.

Figure 6:
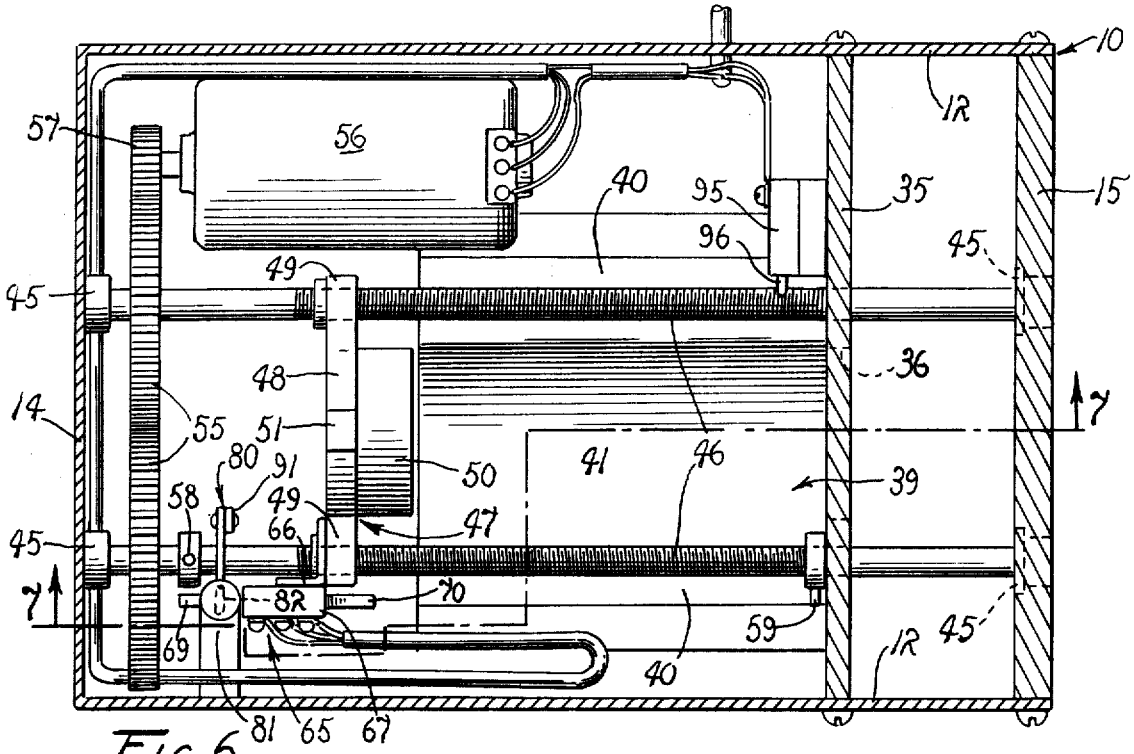
FIG. 6 is a horizontal section taken from a position indicated by line 6—6 in FIG. 4.

A pair of bearing blocks 45 are secured on the end wall 14 and bearing plate 15 within the housing 10 in aligned positions with corresponding bearing blocks defining axes of rotation disposed on opposite sides of the workbed 39 running substantially parallel thereto. A pair of externally screw-threaded shafts 46 are individually secured in corresponding pairs of bearing blocks for rotational movement extending through the interior wall 35, as best shown in FIG. 6. A compression member 47 is mounted on the shafts. The compression member has a mounting plate 48 having opposite, internally screw-threaded mounts 49 which are screw-threadably received on the shafts 46. A block 50 is mounted in a selected position on the mounting plate between the mounts facing and in alignment with the guide passage 36 of the interior wall 35. A projection 51 is integral with the mounting plate and extends toward the door assembly therefrom. The compression member 47 is adapted for movement along the shafts, upon rotation of the shafts, between a retracted position, as best shown in FIG. 6, with the member disposed endwardly of the workbed and an advanced position, not shown, wherein the mounting plate is juxtaposed the interior wall and the block is fully received within the guide passage 36.

A pair of gears 55 are individually mounted on the shafts 46 in driving engagement with each other and affixed to the shafts for rotating the shafts in opposite directions. An electric motor 56 adapted for operation in both forward and reverse directions is mounted on the side wall 12 of the housing 10. The motor can be of any suitable size such as one capable of developing ½ horse power. The motor mounts a drive gear 57 in driving engagement with the adjacent gear 55. A first trip arm 58 is affixed on the shaft 46, on the right as viewed in FIG. 5, for rotation therewith in a predetermined position adjacent to its respective gear 55. A second trip arm 59 is affixed on the same shaft for rotation therewith immediately adjacent to the interior wall 35, as best shown in FIG. 6.

Figure 8:
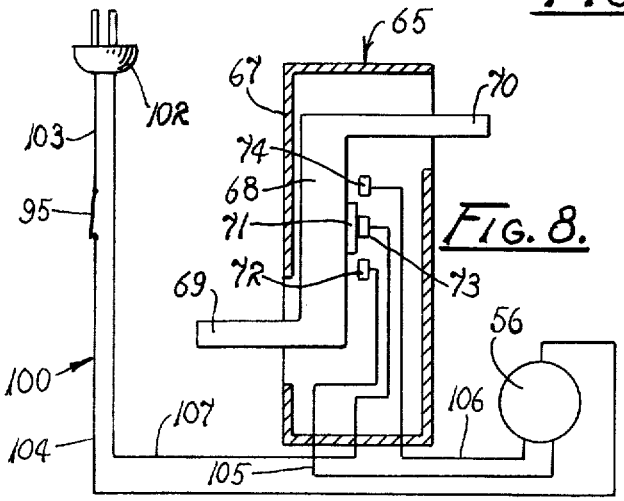
FIG. 8 is a diagrammatic representation of an electrical circuit for the device of the present invention including a schematic illustration of one operative configuration of a switch for the device of the present invention.
Figure 9:
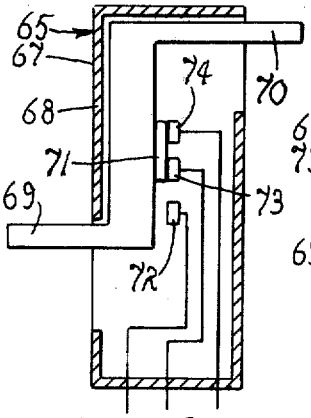
FIG. 9 is a schematic illustration of a second operative configuration for the switch of FIG. 8.
Figure 10:
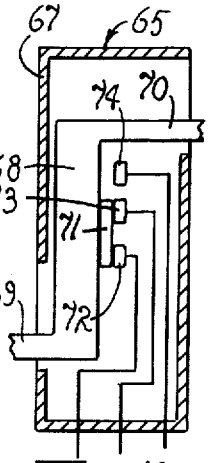
FIG. 10 is a schematic illustration of a third operative configuration for the switch of FIG. 8.

A switch assembly 65 is mounted on the compression member 47 extending laterally of the shaft 46 mounting the trip arms 58 and 59, as best shown in FIG. 6. The switch assembly is composed of an angle bracket 66 secured on the mounting plate 48 of the compression member and having a switch housing 67 mounted thereon in substantially right-angular relation to the mounting plate. The housing mounts an internal switch body 68 of an electrically nonconductive material for slidable movement therewithin. The switch body has an integral first switch arm 69 extending from the housing toward the first trip arm 58 and a second switch arm 70 oppositely extending from the housing in the direction of the second trip arm 59. An electrically conductive plate 71 is fastened on the switch body, as best shown in FIGS. 8, 9 and 10. The housing mounts first, second and third electrical contacts 72, 73 and 74 respectively therewithin for selective engagement by the conductive plate upon slidable movement of the switch body.

Figure 3:
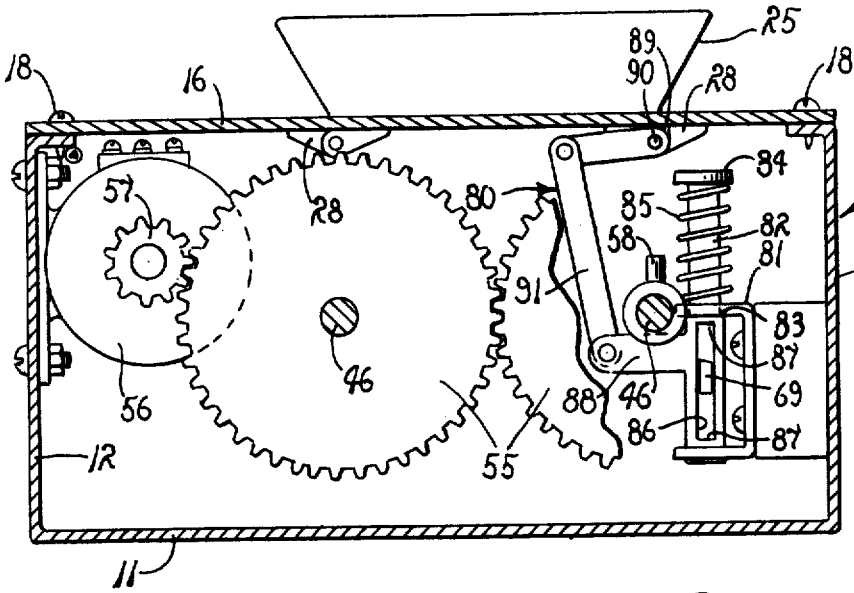
FIG. 3 is a somewhat enlarged fragmentary transverse vertical section taken on line 3—3 in FIG. 2.
Figure 4:
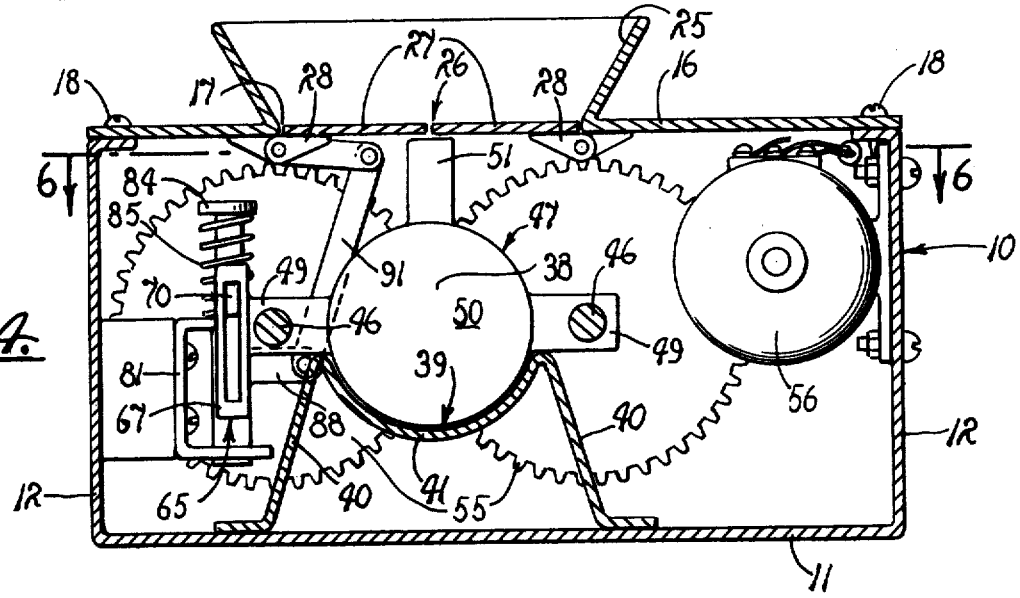
FIG. 4 is a somewhat enlarged transverse vertical section taken on line 4—4 in FIG. 2.

A lever assembly is generally indicated by the numeral 80 in FIG. 3. The lever assembly includes a pluger mount 81 secured on the side wall 12 of the housing 10 adjacent to the first trip arm 58. A plunger 82, having a central shoulder 83 and a radial flange 84 mounted on the distal end thereof, is slidably received in the mount between limits defined by the shoulder and flange. The plunger is resiliently retained in a normal, elevated position, best shown in FIG. 3, by a compression spring 85 disposed about the plunger between the flange and the mount. An elongated slot 86 is provided in the plunger remote from the flange and having predefined opposite ends 87.

The lever assembly 80 further includes an arm 88 extending laterally of the plunger toward the center of the receiving compartment 38. A rod mount 89 is secured on the top wall 16 of the housing within the receiving compartment and adjacent to the pivotal connection 28 of the door 27 nearest the first trip arm 58. A rod 90 is borne by the adjacent door for rotational movement therewith about its axis of rotation during pivotal movement of the door into the housing. The rod is rotationally received in the rod mount, as best shown in FIG. 7. A linkage 91 interconnects the rod 90 and the arm 88 to permit depression of the plunger 82 within the plunger mount upon such movement of the door into the housing.

A safety switch 95, operably mounting a plunger 96, is fastened on the top wall 16 of the housing 10 with the plunger positioned for engagement by the cam 29 of the adjacent door 27 when the door is pivoted into the receiving compartment 38 of the housing. Such movement of the plunger by the door is adapted to open the switch to break the flow of electrical current therethrough for purposes subsequently to be described.

An electrical circuit 100 for the device of the present invention is diagrammatically illustrated in FIG. 8. The housing 10 mounts an insulated electric cord 101 having a conventional electric plug 102 at the remote end thereof, adapted for connection to a suitable wall outlet not shown. An electric conductor 103 is connected to the plug, extended through the cord and connected at its remote end to the safety switch 95. An electric conductor 104 is extended from the safety switch 95 to the electric motor 56. An electric conductor 105 is extended from the motor into the switch housing 67 and is connected to the first electric contact 72. An electric conductor 106 is connected to the electric motor, extended into the switch housing and connected at its remote end to the third electric contact 74. An electric conductor 107 is extended from the second electric contact 73 within the switch housing 67, through the electric cord and is operably connected to the electric plug in the conventional manner.

It will be seen, as shown in FIG. 8, that the direction of drive of the electric motor 56 is controlled by the position of the switch body 68 and thus the conductive plate 71 with respect to the electric contacts 72, 73 and 74. As shown in FIG. 8, the conductive plate is in engagement with only the second electric contact 73 and is thus in a neutral, nonoperative configuration so that power is not supplied from the source to the electric motor. In FIG. 9 the conductive plate is in engagement with the second and third electric contacts 73 and 74 respectively so that the circuit is completed therethrough in a relationship adapted to drive the electric motor in a reverse direction. In FIG. 10 the conductive plate is in contact with the first and second electric contacts 72 and 73 respectively so as to complete the electric circuit to drive the electric motor in a forward direction. It will be seen, as previously noted, that when the plunger 96 of safety switch 95 is depressed the electric circuit is broken therethrough as represented in FIG. 8 so as to prevent the flow of current through the circuit from the source.

Figure 2:
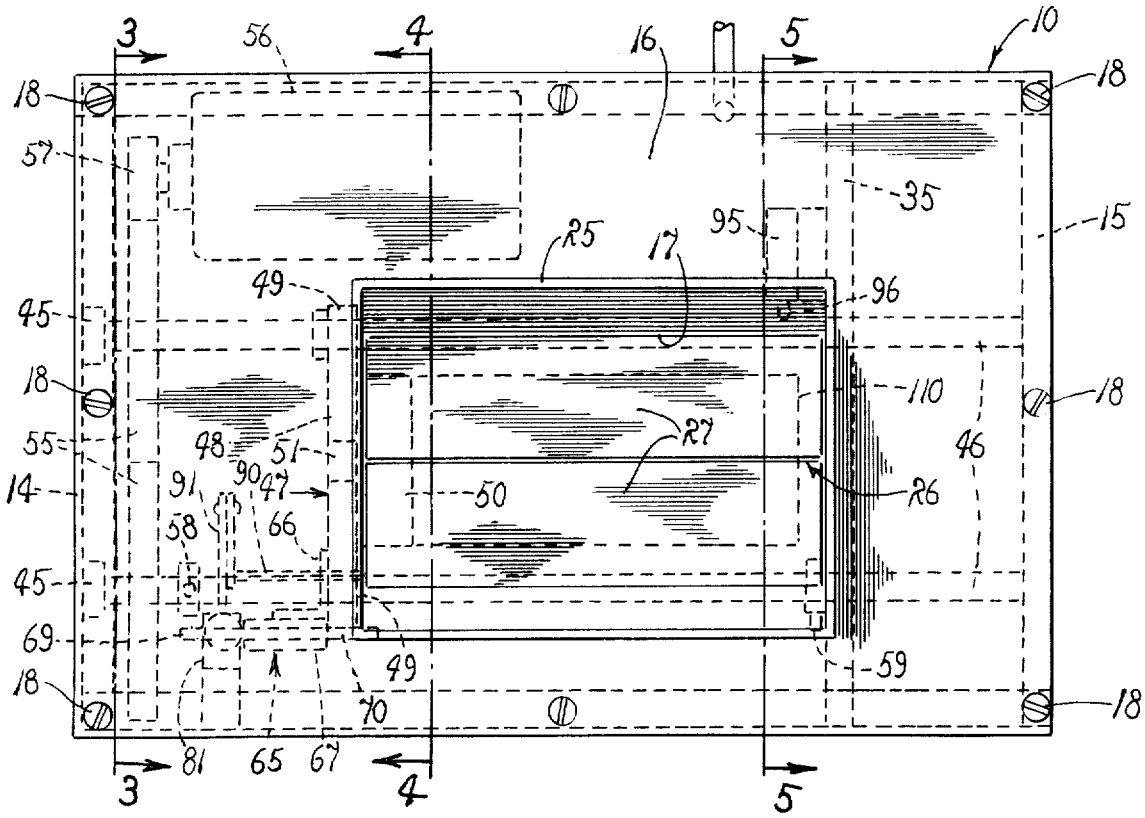
FIG. 2 is a top plan view of the device.

For illustrative convenience an object to be compressed, in this case a beverage container, is indicated by numeral 110 in FIG. 2.

OPERATION

The operation of the described embodiment of the subject invention is believed to be clearly apparent and is briefly summarized at this point. As shown in FIGS. 2, 6 and 7, the compression member 47 is in the retracted position. When the compression member is in this position, the device may be termed as being in a "ready" condition. In this condition the first switch arm 69 of the switch assembly 65 is received in and extended through the slot 86 of the plunger 82 and the doors 27 are retained by their spring tensioned pivotal connections 28 in the closed configuration.

When it is desired to compact an object 110, the object is simply deposited within the hopper 25 in rested engagement with the doors 27. The weight of the object pivots the doors into the receiving compartment 38 gravitationally to deposit the object on the concave portion 41 of the workbed 39. Such pivoting of the doors into the receiving compartment accordingly pivots the rod 90 so as to operate the linkage 91 to depress the plunger 82 against tension of the compression spring 85. Thus the opposite end 87 of the slot is forced downwardly against the first switch arm 69 to motivate the switch body 68 within the switch housing 67 thereby positioning the conductive plate 71 in engagement with the first and second electric contacts 72 and 73 respectively, as shown in FIG. 10. The electric circuit 100 is thus completed through the electric motor in a configuration adapted to operate the electric motor in a predetermined forward direction of operation. However, depression of the doors by the object 110 causes the cam 29 to engage and thus depress the plunger 96 of the safety switch 95 so as to break the electric circuit between electric conductors 103 and 104 so as to prevent the flow of current through the circuit from the source.

After the object 110 has dropped between the doors 27 and on to the workbed 39, the pivotal connections 28 again return the doors to the closed position shown in the drawings. Thus, the cam 29 is pulled out of engagement with the plunger 96 of the switch 95 so as again to complete the circuit through the switch 95. The resulting completion of the circuit causes electric current to flow from the power source through the circuit to the electric motor. The drive gear 57 is rotated in a forward or counterclockwise direction, as viewed in FIG. 1, by the motor. Accordingly, the pair of gears 55 are rotated in opposite clockwise and counterclockwise directions respectively. Thus, the pair of gears rotate the shafts 46 in corresponding clockwise and counterclockwise directions.

The compression member 47 is thus motivated by the rotating shafts 46 from the retracted position, viewed in FIGS. 6 and 7 toward the guide passage 36 of the first wall 35 while traversing the concave portion 41 of the workbed 39. During such movement the block 50 engages the object 110 and carries the object longitudinally of the workbed, through the guide passage, transversely of the discharge passage 37 and into engagement with the bearing plate 15. It will be seen that simultaneously the projection 51 of the compression member 57 is carried along the undersides of the doors 27 so as to prevent opening of the doors into the receiving compartment 38 during operation of the device.

The compression member is carried along the workbed toward the interior wall 35 so as to compress the object between the block 50 thereof and the bearing plate 15. Thus, such movement accomplishes simultaneously the functions of compressing the object and displacing the object from the workbed 39.

When the block 50 is fully received within the guide passage 36, the object 110 is fully compressed between the block and the bearing plate 15 and the compression member has reached its predetermined advanced position. At this position the second switch arm 70 is in position to be tripped by the second trip arm 59 rotating with the shaft 46. Tripping of the switch arm causes the switch body 68 to be moved upwardly within the switch housing 67 to position the conducting plate 71 in engagement with the second and third electric contacts 73 and 74 respectively, as shown in FIG. 9. This places the electrical circuit 100 in a configuration adapted to operate the electric motor 46 in a reversed direction. Thus the drive gear 57 is rotated in a reverse or clockwise direction, as viewed in FIG. 1, so as to rotate the gears 55 and thus the shafts 46 in opposite directions. Such rotation of the shafts causes the compression member 47 to be withdrawn from the advanced position to the retracted position. Retraction of the compression member pulls the block 50 out of engagement with the object 110 thereby allowing the object gravitationally to be discharged from the device through the discharged passage 37 for retrieval by the operator.

Continued movement of the compression member 47 returns the switch assembly 65 to the position shown in FIGS. 6 and 7 with the first switch arm 69 received through the slot 86 of the plunger 82. When the compression member and switch assembly have reached the retracted position the first trip arm 58 trips the first switch arm 68 to motivate the switch body 68 downwardly in the switch housing 67 to the neutral position shown in FIG. 8. Thus the electric circuit 100 is broken so as to terminate the flow of electrical current from the source to the motor 56 and thereby stop the movement of the compression member. The device is then again in a ready condition for the depositing of a new object to be compressed within the hopper 25.

It will be readily apparent that a variety of other combinations of switches, lever assemblies and electrical circuits could be employed in the device of the present invention to accomplish the described operation. However, the specific embodiment herein described is believed to have operational advantages in the simplicity and dependability of performance thereof. It will also be apparent that the device could easily be adapted for compacting a wide variety of types, sizes and shapes of objects by varying the size and shape of the workbed 39 and of the guide passage 36 as well as the overall dimensions of the device. Thus, the device is adaptable for both household and industrial use.

The object compacting device of the present invention is capable of reliable fully automatic operating from insertion of the object to be compacted until its discharge from the device, precludes injury to the operator of the device and is of a size and cost fully compatible with household as well as other uses.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. An object compacting device comprising a housing having an object receiving opening; a bearing plate borne by the housing; means enclosed in the housing for receiving an object in alignment with the bearing plate and disposed in spaced relation to said bearing plate defining a passage for gravitational discharge of the object from the housing; means for compressing the object against the bearing plate by traversing the receiving means to displace the object from the receiving means upon compression against the bearing plate; means mounted on said housing for preventing entry through the receiving opening during operation of the compressing means; and a wall mounted on the housing adjoining the receiving means and spaced from the bearing plate, said wall having an object stabilizing passage extending therethrough interconnecting the receiving means and the discharge passage.

2. An object compacting device comprising a housing having a bearing plate at one end thereof and an entrance opening; a wall having an object receiving passage mounted in the housing in spaced relation to the bearing plate to divide the housing into an object receiving compartment communicating with the entrance opening and an object discharge compartment communicating with the receiving compartment through the receiving passage; a workbed secured on the housing in the receiving compartment in endward alignment with the receiving passage and in alignment with the entrance opening; a compression member; and means for transporting said compression member across the workbed to and from the receiving passage in response to the insertion of an object on to the workbed through the entrance opening.

3. The device of claim 2 wherein a door assembly is borne by the housing for movement to and from a closed position in the entrance opening and said compression member has a portion thereof adapted for engagement with the door assembly in the closed position during transport of the member across the workbed to prevent entrance to the receiving compartment.

4. The device of claim 3 wherein the transporting means includes a screw-threaded shaft mounted on the housing for rotational movement substantially parallel to the workbed and mounting the compression member for movement therealong upon rotation of the shaft, said transporting means further including drive means for rotating said shaft.

5. The device of claim 4 wherein a switch assembly is borne by the compression member, an electrical circuit interconnects said switch assembly in controlling relation to the drive means, and trip members are affixed on the shaft for rotation therewith in selected positions to reverse movement of the compression member from an advanced position at the object receiving passage and to stop movement of said member in a retracted position by selective tripping of the switch assembly.

6. The device of claim 5 wherein a lever assembly operably interconnects the door assembly and the switch assembly when the compression member is in the retracted position whereby movement of said door assembly from the closed position trips the switch assembly to activate the drive means.

7. The device of claim 6 wherein a normally closed second switch assembly is fastened on the housing in position for engagement by the door assembly in an open position and said second switch assembly is connected to the electrical circuit to interrupt said circuit when the door assembly is opened so as to prevent movement of the compression member until the door assembly is returned to the closed position.

8. An object compacting device for operation in protectively sealed condition, the device comprising a housing enclosing an object receiving compartment and an object discharge passage, said housing having an insertion opening in communication with the receiving compartment; a first wall having a guide opening extended therethrough mounted on the housing intermediate the receiving compartment and the discharge passage; a second wall mounted on the housing spaced from and substantially parallel to the first wall bounding the discharge passage and in alignment with the guide opening; an elongated frame secured in the receiving compartment opposite the insertion opening and in substantially longitudinal alignment with the guide opening; a pair of substantially parallel screw-threaded shafts mounted for rotational movement on the housing on opposite sides of the frame; a compression member borne by the shafts for movement upon the rotation of said shafts between a retracted position and an advanced position adjacent the guide opening longitudinally of the frame; a pair of trip arms fastened on one of said shafts individually adjacent to the retracted position and the guide opening respectively; reversible drive means for rotating said shafts; a door assembly mounted on the housing for movement between a position in sealing relation to the insertion opening and an open position; a switch assembly borne by the compression member having oppositely extending switch arms adapted individually to be tripped by the trip arms to control movement of said compression member over the frame; a lever assembly mounted on the housing and connected to the door assembly adapted to trip a selected switch arm of the lever assembly when the door assembly is moved to the open position and the compression member is in the retracted position; and an electrical circuit, adapted for connection to a source of electrical energy, interconnecting the drive means and the switch assembly adapted to activate the drive means upon opening of the door assembly to deposit an object on the frame, to reverse the drive means and thus rotation of the shafts upon tripping of a selected switch arm of the switch assembly by the trip arm adjacent to the guide opening and to deactivate the drive means upon tripping of the other switch arm by the other trip arm when the compression member is in the retracted position.

9. The device of claim 8 wherein the compression member includes a block adapted to engage an object received on the frame during movement thereof to the advanced position to displace said object from the frame through the guide opening whereby the object is compressed between the block and the second wall and wherein the block is fully received within the guide opening when the compression member is in the advanced position to permit gravitational discharge of the compressed object through the discharge passage upon subsequent movement of the compression member to the retracted position.

10. The device of claim 9 wherein a switch is fastened on the housing in position for operation by the door assembly when moved to the open position and connected in series with the electrical circuit to break said circuit upon operation by the door assembly.

11. The device of claim 10 wherein the door assembly is resiliently retained in the sealed position and the compression member has a projection extending toward said door assembly to prevent movement thereof from the sealed position during movement of the compression member between the advanced and retracted positions.

* * * * *